US010343751B2

(12) United States Patent
Hollen et al.

(10) Patent No.: US 10,343,751 B2
(45) Date of Patent: Jul. 9, 2019

(54) WATER RESCUE DEVICE FOR PERSONAL ITEMS

(71) Applicant: Floatt Buddy, Inc., Fallentimber, PA (US)

(72) Inventors: David Hollen, Fallentimber, PA (US); Michael P. Coccia, Fallentimber, PA (US); Harvey E. Downey, Fairview, PA (US); Jeffrey Williams, Fairview, PA (US)

(73) Assignee: Float Buddy, LLC, Fallentimber, PA (US)

( * ) Notice: Subject to any disclaimer, the term of this patent is extended or adjusted under 35 U.S.C. 154(b) by 0 days.

(21) Appl. No.: 16/011,671

(22) Filed: Jun. 19, 2018

(65) Prior Publication Data

US 2018/0362119 A1 Dec. 20, 2018

Related U.S. Application Data

(60) Provisional application No. 62/522,132, filed on Jun. 20, 2017.

(51) Int. Cl.
*B63B 22/08* (2006.01)
*B63C 9/18* (2006.01)
*B63B 22/22* (2006.01)

(52) U.S. Cl.
CPC ..... *B63B 22/08* (2013.01); *B63B 22/22* (2013.01); *B63C 9/18* (2013.01)

(58) Field of Classification Search
CPC ..... B63B 22/08; B63B 22/22; B63C 9/18
USPC ..... 441/6–9, 21–23, 30, 32, 136
See application file for complete search history.

(56) References Cited

U.S. PATENT DOCUMENTS 2,123,446 A * 7/1938 Veenstra ..... B63C 9/18 441/100
2,687,541 A * 8/1954 Bannister ..... B63B 22/12 114/54
3,035,285 A * 5/1962 Squires, Jr. ..... B63B 21/28 114/295
3,746,285 A * 7/1973 Mango ..... B64B 1/62 116/210
6,036,559 A * 3/2000 Arnold ..... A01K 87/00 441/6
7,232,354 B2 * 6/2007 Olson ..... B63B 22/10 441/7
7,540,796 B2 * 6/2009 Spears ..... B63B 22/08 441/8
8,882,391 B2 * 11/2014 Stenzel ..... B63B 21/66 405/171

(Continued)

*Primary Examiner* — Daniel V Venne
(74) *Attorney, Agent, or Firm* — McKay & Associates, P.C.

(57) ABSTRACT

A salvaging device, particularly for a personal device such as a smartphone dropped into a body of water. A housing has an opening and a gas cartridge. A triggering mechanism is further packed within the housing, which includes a lever arm. A main spring is above the lever arm cocking the lever arm in a downward position. A plunger is aligned with the gas cartridge. A water-soluble retainer abuts the lever, wherein upon the retainer dissolving in a water environment, the main spring recoils to thereby unload the plunger into the gas cartridge such that gas can exit the opening. A balloon is connected at the opening inflatable by the gas to thereby provide a buoyancy force to the handheld device upon inflation.

19 Claims, 4 Drawing Sheets

(56) References Cited

U.S. PATENT DOCUMENTS

| | | | | |
|---|---|---|---|---|
| 9,650,112 | B1 * | 5/2017 | Milam | B63B 22/08 |
| 9,803,951 | B1 * | 10/2017 | Mashburn | F41B 5/148 |
| 9,841,145 | B1 * | 12/2017 | Powell | F17C 7/00 |
| 2008/0311805 | A1 * | 12/2008 | Spears | B63B 22/08 441/30 |

* cited by examiner

SECTION A-A

WATER RESCUE DEVICE FOR PERSONAL ITEMS

CROSS-REFERENCE TO RELATED APPLICATIONS

The instant application claims benefit of provisional application Ser. No. 62/522,132, filed Jun. 20, 2017, the contents of which are incorporated herein by reference.

BACKGROUND

Field of the Invention

The instant invention relates to a water-activated device that is adapted to salvage a user's smartphone or any device of value should the device fall into a body of water.

Description of the Related Art

Specialized, hand-held devices such as smartphones can be water-resistant or water-proof, or separate accessory cases can be purchased to make them more water resistant in the event a user's device should fall into a body of water or otherwise get wet. However, if a smartphone is accidentally dropped into a dark, deep body of water such as a lake, the device will fall to the bottom of the lake and likely never be recovered. The water-proofing accessory serves no purpose in this instance since, although the phone may be usable, it is lost.

In addition, even if a smartphone is ruined after having been submerged in a body of water, the damaged device still has trade-in value or other value potentially under a user's phone plan. Moreover, although the smartphone may not function, the content on the phone such as contacts and pictures may still be retrievable.

Devices for salvaging personal items from water are known. U.S. Pat. No. 7,540,796 to Spears et al. is directed toward a device which provides buoyancy to objects. The invention comprises a water-sensitive trigger which, when activated, causes a balloon to inflate, causing the object to float upon the surface where the user can then easily and safely retrieve it, through one of two mechanisms: first, a compressed gas is allowed to exit a canister and enter a balloon, second, one or more substances which, when mixed with water will produce bubbles are exposed to water and the balloon is filled with bubbles from the chemical reaction.

U.S. Pat. No. 6,036,559 to Arnold et al. teaches a flotation device for causing an article to float if accidently dropped into water. The flotation device includes a casing, a compressed gas cartridge, a pierce head biased by compression of a firing spring, at least one trigger, a dissolvable ring, and a balloon. Escaping compressed gas fills the balloon and results in a positive buoyancy which floats an attached article.

U.S. Pat. No. 8,430,704 describes a device which will act efficiently as a float for any article (e.g. keys, mobile telephone, wallet) attached thereto when dropped into water comprising an inflatable bag of substantially waterproof and air impervious material, a container of compressed gas, and trigger means associated with the container and operable upon immersion of the device in water to open the container and allow gas from the container to inflate the bag.

U.S. Pat. No. 8,961,250 to Meyer teaches a self-inflating device which can include a container configured to receive a chemical compound, a one-way valve covering an opening leading to an inner volume of the container, and an inflatable portion fluidly connected to the inner volume of the container and configured to inflate with gas produced when the chemical compound is exposed to water. The inflatable portion can be configured to inflate when a gas pressure inside the self-inflating device exceeds a water pressure outside the self-inflating device.

However, today's modern, sleek mobile devices are aethestically pleasing and ergonomic to the extent the accessories also demand that they be un-intrusive and functional. For example, components which aid in the phone's hand-holding ability or small camera attachments are but a few attachable accessories for mobile phones which increase their functionality or add to their ease of use without taking away from their everyday need and look and feel. The instant accessory for salvaging the device in the instant the phone is dropped into a body of water is in line with modern demands and is not cost-prohibitive. Accordingly, it is desirable to have a means for recovering a phone or preventing the loss of the phone, or any device, within a body of water, as follows.

SUMMARY

Comprehended is a water rescue device for a hand-held device, including a housing, the housing having defined therein a water inlet, an inflatable bladder within the housing, an air cartridge for inflating the bladder, a trigger for releasing the air, the trigger actuated by an environmental influence of water, wherein in response to the environmental influence the bladder inflates, resulting in positive buoyancy such that the hand-held device can float to the surface of any body of water.

More particularly, comprehended is a salvaging device, comprising a housing. The housing has an opening and a gas cartridge. A triggering mechanism is further packed within the housing, which includes: a lever arm having a plunger end and an arm end; a main spring within the housing above the lever arm cocking the lever arm in a downward position; a plunger over the plunger end, the plunger aligned with the gas cartridge; a retainer over the arm end, the retainer being water soluble and abutting the lever, wherein upon the retainer dissolving in a water environment, the main spring recoils to thereby unload the plunger into the gas cartridge such that gas can exit the opening. A plunger spring encircles the plunger, thereby maintaining the plunger above the gas cartridge, and a pin is disposed through the lever arm at the plunger end to retain the lever arm. A balloon is connected at the opening inflatable by the gas to thereby provide a buoyancy force to the handheld device upon inflation as the: retainer dissolves; the main spring recoils; the plunger unloads into and pierces the gas cartridge to fill the balloon.

DETAILED DESCRIPTION OF THE PREFERRED EMBODIMENT

Figure 1:
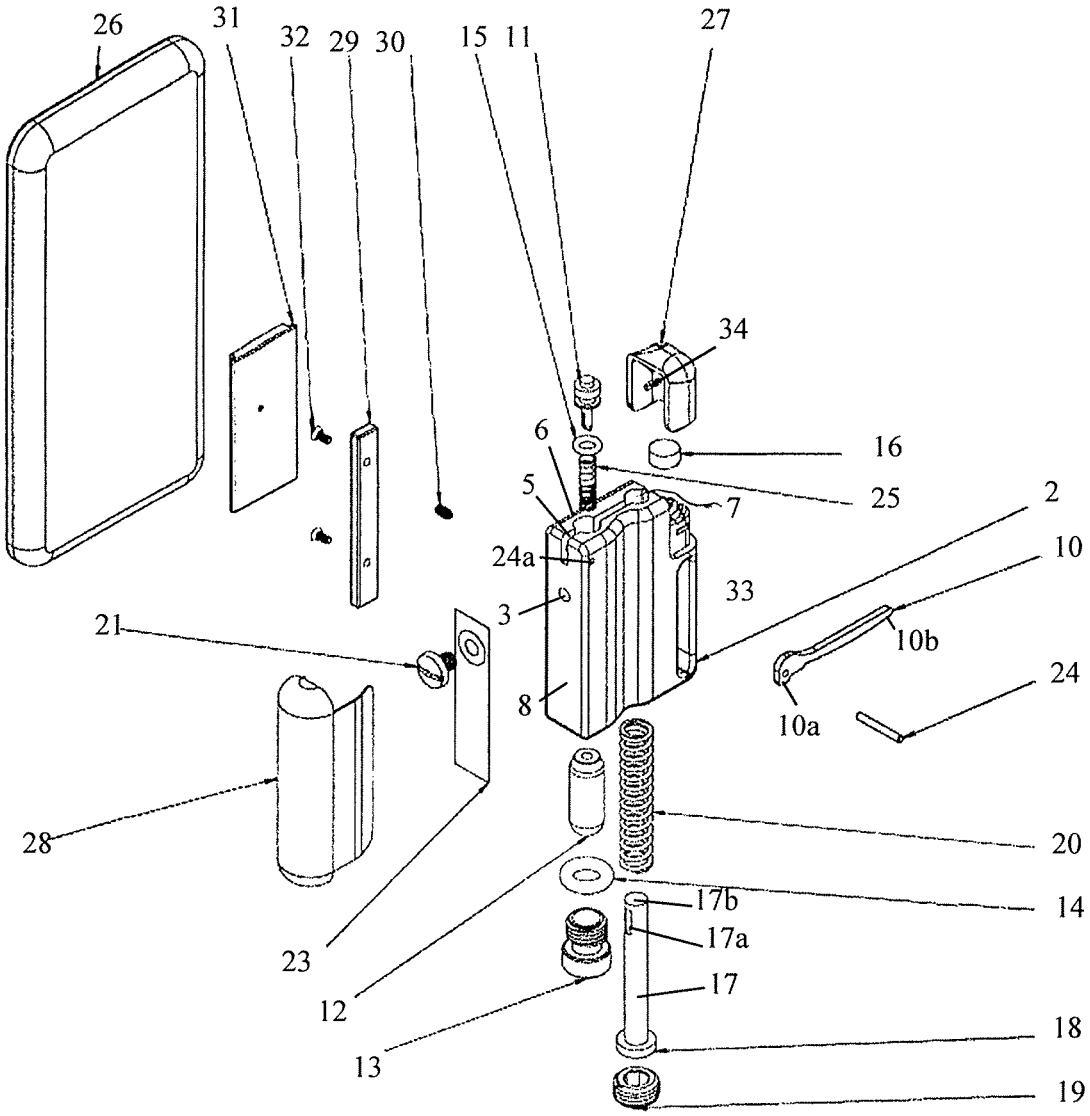
FIG. 1 shows an exploded perspective view of the instant salvaging device.
Figure 2:
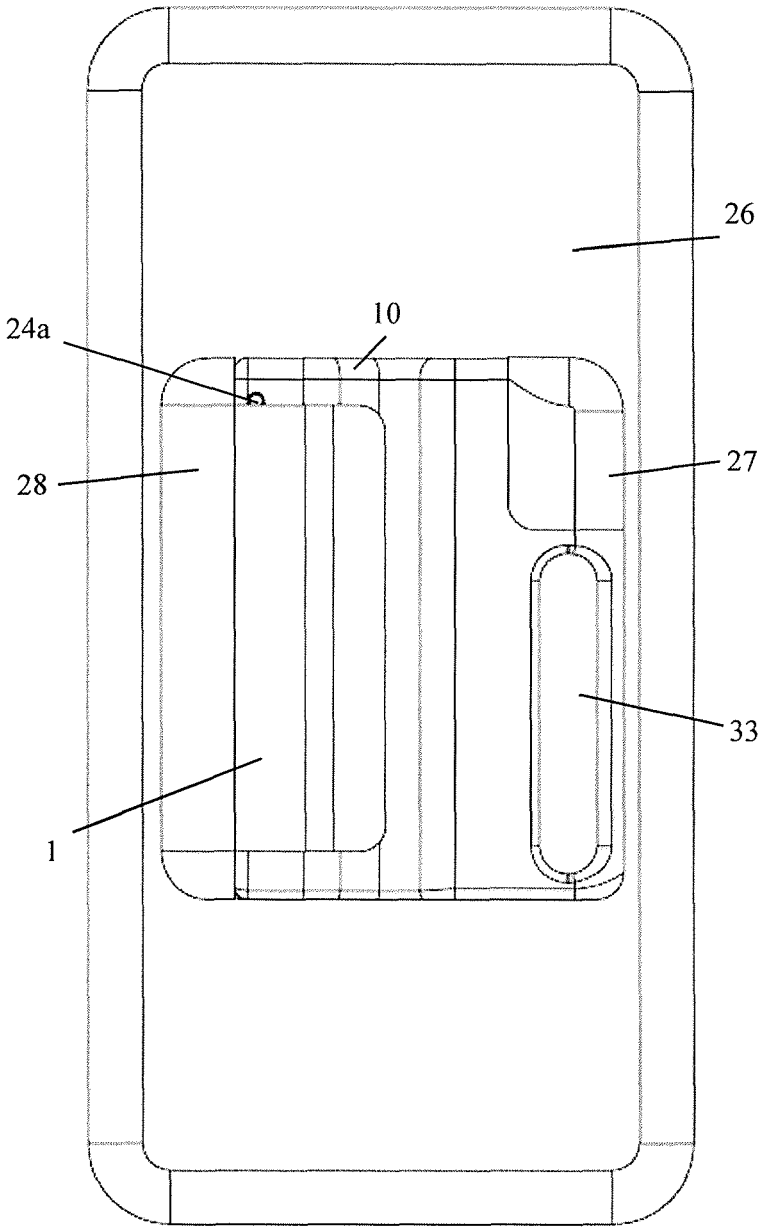
FIG. 2 shows a front view in elevation of the salvaging device on use on a smartphone.
Figure 3:
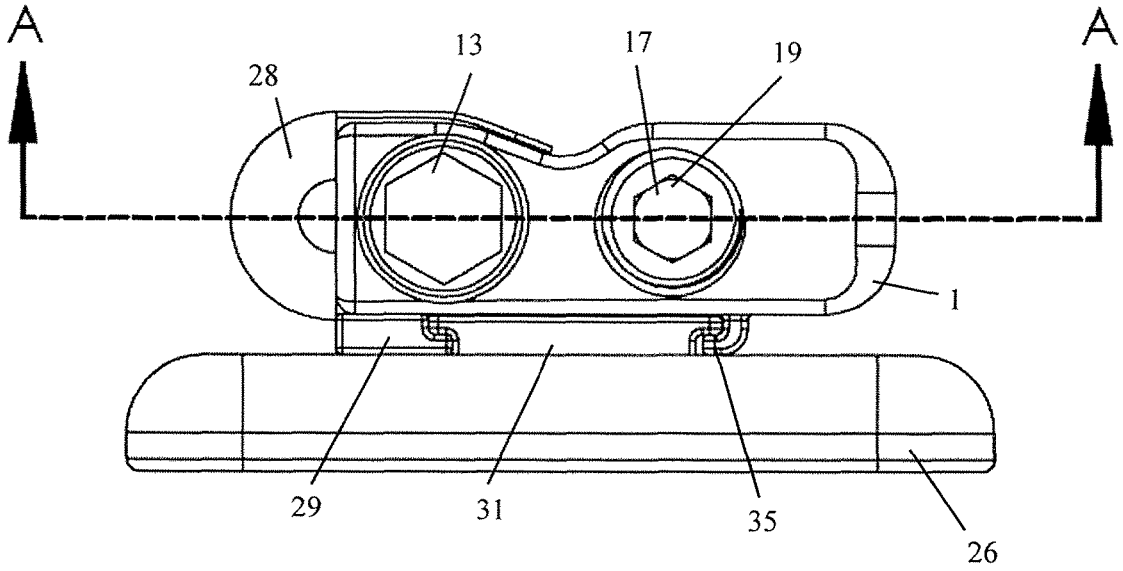
FIG. 3 shows a top elevation view thereof included the section A-A.
Figure 4:
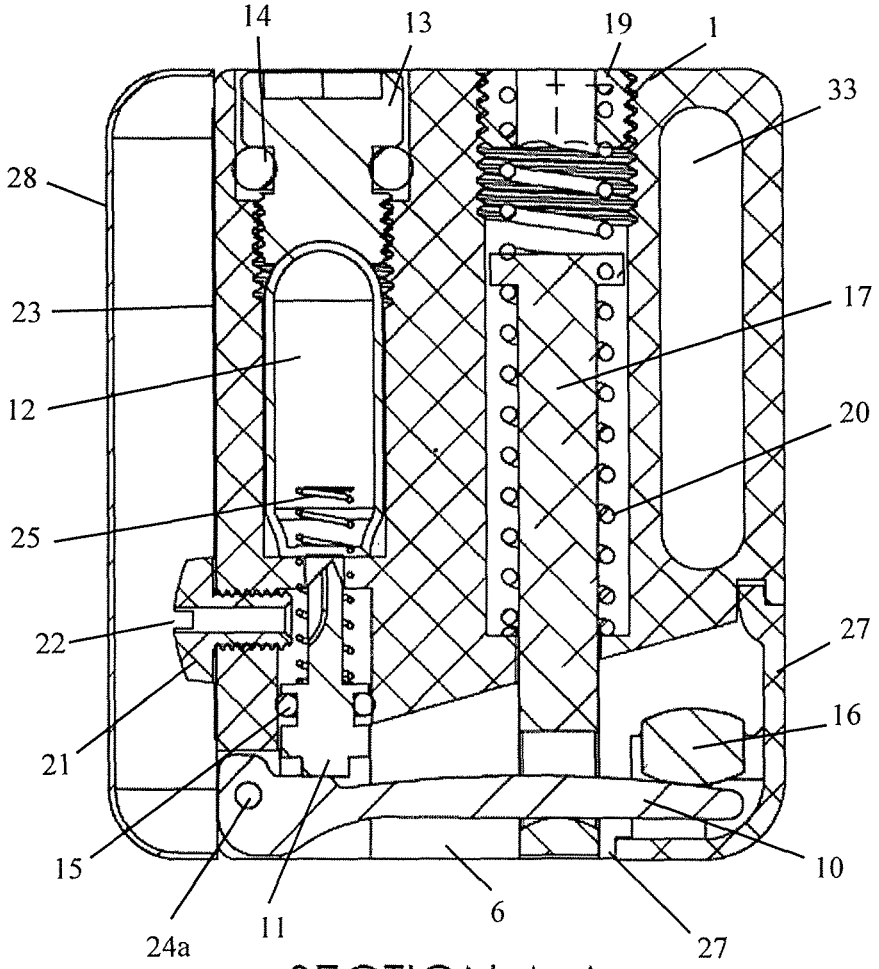
FIG. 4 shows the section view through section A-A.

Referencing FIGS. 1-4, shown is the instant salvaging device 1. In the exemplar embodiment as shown, the salvaging device 1 is used on a smartphone 26. Smartphone 26 means any handheld mobile device such as a smartphone 26, cellular phone, tablet, portable media device or personal digital assistant. Although a smartphone 26 is shown as the exemplar embodiment, it should be understood that the salvaging device 1 could be used on any hand-held product of value, including but not limited to fishing rods, a radio-controlled vehicle (boat) or drone. The salvaging device can be integrated into the hand-held product (or its case or accessory) or be attached thereto. Any reference to a directional term such as "upward" or "downward" is used merely to identify or distinguish components and the action of any component would depend on the orientation of the salvaging device 1. In addition, "A" or "an" as used in the claims means one or more.

The salvaging device 1 includes a housing 2. Housing 2 is preferably made of a lightweight composite or any rigid or semi-rigid material. A pass-through 34 can be defined at any location at housing 2 so that the salvaging device 1 can have attached thereto a tether or similar. In a further embodiment, an LED can be attached to or fill the pass-through 34 to aid in visibility. Generally, housing 2 is the unitary containment element which contains the triggering mechanism 4 and other components, as follows.

Housing has an opening 3 defined as a hole on the exterior side 8 as shown. A housing slot 5 is defined transaxially at a housing top 6. Transaxially means across the axis if the axis is defined vertically through the housing. Housing slot 5 is expanded radially along its length at two locations to form a pair of cylindrical pockets 7 within housing 2. Housing slot 5 is sized to contain the lever arm 10 of triggering mechanism 4 and other components, as further described.

A gas cartridge 12 is contained within the housing 2 near the exterior side 8 in one of the pockets 7. Gas cartridge 12 is a gas-containing cylinder. For example, but not limiting by any means, the gas cartridge 12 can be a small-volume carbon dioxide chamber having an internal volume of 1.0 ml and a gas weight of 0.75 grams at a 75% fill density. Such a cylinder is approximately 25 mm in length and is adapted to have a minimum burst force of 7250 psi and pressure 850 psi (at 70° F.). Gas cartridge 12 could include a zinc-finished body, an opening (not shown) and a puncture cap (not shown) for sealing the opening. In the exemplar embodiment the puncture cap requires a puncture force of 160 Nf to release the gas from gas cartridge 12. Gas cartridge 12 is retained internally using gas cylinder screw 13, allowing the gas cartridge 12 to be removable and replaceable from housing 2. In other words, gas cylinder screw 13 abuts and contains the gas cartridge 12 in alignment with the plunger 11 within said housing, as further described.

A triggering mechanism 4 is further packed within the housing 2. The triggering mechanism 4 is the subassembly for releasing the gas from gas cartridge 12. The triggering mechanism 4 punctures the gas cartridge 12. Although various triggering mechanisms might be contemplated, in the exemplar embodiment as shown, a lever arm 10 has a plunger end 10*a* and an arm end 10*b*. Plunger end 10*a* is nearest to exterior side 8 of housing 2. The lever arm 10 is situated within the housing slot 5 as shown at the housing top 6. A pin hole 24*a* is defined at the plunger end 10*a*. Accordingly, a pin 24 can be inserted through pin hole 24*a* to retain the lever arm 10 at this location with the plunger end 10*a* under but aligned with the gas cartridge 12.

Lever arm 10 is retained in a cocked position by provided a main spring 2 within one of the pockets 7. More particularly, a spring piston 17 is seated within one of the pockets 7 as shown. A set screw 19 packs the spring piston 17 against the main spring 2 within the housing 2. Spring piston 17 has a piston slit 17*a* at its upward end 17*b*. Lever arm 10 is allowed to pass through piston slit 17. Spring piston 17 includes a piston flange 18, the piston flange 18 having a greater diameter than both the main spring 2 and the spring piston 17 (t-shaped cross section) so that the piston flange 18 can grab the main spring 2 when the spring piston 17 is engaged to the main spring 2. In other words, the main spring 2 encircles the spring piston 17 and engages the piston flange 18. As such, main spring 2 can be pulled to be an uncoiled, stretched, or hereinafter "cocked" position which is also defined as a downward position with reference to FIG. 4.

A plunger 11 is disposed over the plunger end 10*a*, the plunger 11 aligned with the gas cartridge 12. The plunger 11 is seated within one of the pockets 7 and sealed using plunger seal 15, which is an o-ring. Plunger 11 can take any form so long as it has some pointed end or means to puncture the puncture cap of gas cartridge 12. In this embodiment a plunger spring 25 encircles plunger 11 so that when the plunger spring 25 is in a relaxed state the plunger 11 is over the gas cartridge 12 and urged to remain at that location until a forced is exerted thereon.

A retainer 16 is disposed over the arm end 10*b* of lever arm 10. Herein, the retainer 16 is water soluble, taking the form, for example, as a salt pill. Because the retainer 16 abuts lever arm 10 when in an undissolved, solid form, it holds the lever arm 10 in place, wherein upon the retainer 16 dissolving in a water environment, the main spring 20 recoils to thereby release the retained lever arm 10 upward and, as a result, unload the plunger 11 into the gas cartridge 12. A pill cover 27 maintains the retainer 16 within the housing 2 when retainer 16 is undissolved such that the pill cover 27 also aids to maintain the triggering mechanism 4 in a cocked form. More particularly, a lip 34 is formed within pill cover 27 to specifically abut and temporarily secure the retainer 16. The pill cover 27 is removable and re-attachable, wherein the retainer 16 can be replaced upon dissolution, and the retainer 16 and triggering mechanism 4 can be reset. Additionally, the pill cover 27 does not entirely seal the housing 2 at this location, resulting in defined entryway 27*a* which allows for the passage of water.

A balloon 23 is connected at the opening 3 of housing 2 (see exterior side 8). In the exemplar embodiment balloon 23 is foldable mylar balloon. Balloon 23 is connected to exterior side 8 using balloon fastener 21, which is a screw, rivet, pin or similar shaped to tie into opening 3 but also includes a concentric faster hole 22 which serves as the outlet for the gas. Accordingly, balloon fastener 21 secures the balloon but does not plug the opening 3. Balloon 23 can include a donut or ring (not shown) at its end forming a circular handle to aid in retrieval from the water.

A balloon cover 28 is adapted to snap onto housing 2 and cover exterior side 8 and thus all elements at this location including the balloon fastener 21. A balloon rail 29 can be provided to "tie down" the balloon cover 28 on the opposite side, only with the force necessary to temporary maintain the balloon cover 28 before the balloon cover 28 is partially dislodged by the force of the inflated balloon 23. Rail fasteners 32 are used to secure the balloon rail 29 onto housing 2.

The entire salvaging device 1 is mounted to a hand-held device (smartphone 26) by providing the following. A mount 31 is removably attachable to the smartphone 26. The mount 31 for example can be a T-shaped tacky mount. The housing 2 includes at least one engagement tab 35 for mating with the mount 31, wherein the salvaging device 1 can slidably engage the mount 31. Of note and with reference to FIG. 3, the balloon rail 29 serves as the other engagement point. The salvaging device 1 can be "locked" (or removably secured) to the smartphone 26 by providing a ball nose plunger 30 and any receiving hole (not shown) on the backside of housing 2.

In use, when an object such as a smartphone 26 having the salvaging device 1 attached thereto falls and is thereby submerged in a body of water, water enters the triggering mechanism 4 through entryway 27*a*. Water dissolves the retainer 16, whereupon lever arm 10 is pulled upward (in relation to FIG. 4) as a result of the main spring 20 relaxing. This upward action drives the plunger 11 also upward at the opposite end, thereby piercing the gas cartridge 12. Gas from gas cartridge 12 is released, traveling through opening 3 (faster hole 22) and into balloon 23 to fill balloon 23. As a result, the force of the balloon 23 inflating partially pops off balloon cover 28. The inflated balloon 23 then provides a buoyancy force greater than the smartphone buoyancy force, in turn floating the smartphone 26 to the surface of the body of water, allowing for retrieval.

We claim:

1. A salvaging device, comprising:
- a housing having an opening;
- a gas cartridge within said housing;
- a triggering mechanism packed within said housing, said triggering mechanism further comprising:
  - a lever arm having a plunger end and an arm end;
  - a main spring within said housing above said lever arm cocking said lever arm in a downward position;
  - a plunger over said plunger end, said plunger aligned with said gas cartridge;
  - a retainer over said arm end, said retainer being water soluble and abutting said lever, wherein upon said retainer dissolving in a water environment, said main spring recoils to thereby unload said plunger into said gas cartridge such that gas can exit said opening; and,
- a balloon connected at said opening inflatable by said gas to thereby provide a buoyancy force.

2. The salvaging device of claim 1, further comprising a plunger spring encircling said plunger maintaining said plunger above said gas cartridge.

3. The salvaging device of claim 1, further comprising a pin disposed through said lever arm at said plunger end.

4. The salvaging device of claim 1, wherein said housing has a slot defined transaxially at a top thereof, said slot sized to contain said lever arm.

5. The salvaging device of claim 4, wherein said slot is expanded radially at two locations to form a pair of cylindrical pockets.

6. The salvaging device of claim 5, wherein said plunger is seated within one of said pockets.

7. The salvaging device of claim 6, further comprising a spring piston within said housing and within the other of said pockets, said spring piston including a piston flange.

8. The salvaging device of claim 7, wherein said main spring encircles said spring piston and abuts said piston flange.

9. The salvaging device of claim 1, further comprising a gas cylinder screw abutting and containing said gas cartridge in alignment with said plunger within said housing, wherein said gas cylinder screw can be removed to thereby allow for the replacement of said gas cylinder.

10. The salvaging device of claim 7, further comprising a set screw for packing said spring piston against said main spring within said housing.

11. The salvaging device of claim 1, wherein said balloon is connected to an exterior side of said housing.

12. The salvaging device of claim 11, further comprising a balloon fastener connecting said balloon to said exterior side, said balloon fastener having fastener hole concentrically defined therein through which some of said gas can pass while concurrently filling said balloon.

13. The salvaging device of claim 1, wherein said housing has a pass-through defined therein.

14. A salvaging device, comprising:
- a housing having an opening and a slot defined transaxially at a top thereof, said slot expanded radially at two locations to form a pair of cylindrical pockets;
- a replaceable gas cartridge within one of said pockets;
- a replaceable triggering mechanism packed within said housing;
- a retainer within said housing, said retainer being water soluble, wherein upon said retainer dissolving in a water environment, said triggering mechanism unloads a plunger into said gas cartridge to release gas through said opening;
- a pill cover maintaining said retainer within said housing when said retainer is undissolved such that said pill cover also aids to maintain said triggering mechanism in a cocked form, said pill cover being removable and re-attachable, wherein said retainer can be replaced upon dissolution and said triggering mechanism can be reset; and,
- a balloon secured at said opening inflatable by said gas to thereby provide a buoyancy force.

15. A salvaging device for a smart-phone, comprising:
- a housing having an opening and an exterior side;
- a gas cartridge within said housing;
- a triggering mechanism packed within said housing;
- a retainer within said housing, said retainer being water soluble, wherein upon said retainer dissolving in a water environment, said triggering mechanism unloads a plunger into said gas cartridge to release gas through said opening;
- a mount removably attachable to said smartphone;
- said housing including a pair of engagement tabs, wherein said housing can slidably engage said mount; and,
- a balloon secured at said opening inflatable by said gas to thereby provide a buoyancy force to said smartphone.

16. The salvaging device of claim 15, wherein said mount is generally T-shaped in cross-section.

17. The salvaging device of claim 15, further comprising a balloon cover adapted to removably attach over said exterior side and cover said balloon.

18. The salvaging device of claim 15, further comprising a ball nose spring plunger on said housing.

19. The salvaging device of claim 17, further comprising a balloon rail for securing said balloon cover.

* * * * *